US007107914B2

(12) United States Patent
Sherman

(10) Patent No.: US 7,107,914 B2
(45) Date of Patent: Sep. 19, 2006

(54) MODULAR TABLE SYSTEM

(76) Inventor: Brad J. Sherman, 201 NW 39th St., #308, Seattle, WA (US) 98107

( * ) Notice: Subject to any disclaimer, the term of this patent is extended or adjusted under 35 U.S.C. 154(b) by 3 days.

(21) Appl. No.: 10/838,284

(22) Filed: May 4, 2004

(65) Prior Publication Data

US 2005/0247241 A1 Nov. 10, 2005

(51) Int. Cl.
*A47B 57/00* (2006.01)

(52) U.S. Cl. ..... 108/64; 108/65; 108/66

(58) Field of Classification Search ..... 108/64, 108/65, 67, 69, 59, 77, 78, 23
See application file for complete search history.

(56) References Cited

U.S. PATENT DOCUMENTS

| | | | | |
|---|---|---|---|---|
| 2,484,283 | A | 10/1949 | Gilbert et al. | |
| 2,836,475 | A | 5/1958 | Sapp | |
| 3,053,598 | A * | 9/1962 | Cheslow | 108/64 |
| 3,714,906 | A | 2/1973 | Finestone | |
| 3,741,852 | A * | 6/1973 | Keener | 108/64 |
| 3,742,869 | A | 7/1973 | Polsky et al. | |
| 3,955,850 | A | 5/1976 | Toso | |
| D268,715 | S | 4/1983 | Curry | |
| D288,756 | S | 3/1987 | McCarty | |
| 4,815,392 | A * | 3/1989 | Soot | 108/65 |
| 4,878,439 | A * | 11/1989 | Samson | 108/64 |
| 5,341,750 | A | 8/1994 | Fuchs | |
| 5,438,937 | A | 8/1995 | Ball et al. | |
| 5,485,795 | A * | 1/1996 | Williams | 108/64 |
| 5,595,427 | A | 1/1997 | Peters et al. | |
| 5,622,118 | A * | 4/1997 | Rowan | 108/65 |
| 5,673,631 | A * | 10/1997 | Guns et al. | 108/64 |
| 5,918,932 | A * | 7/1999 | Morrison et al. | 108/23 |
| 5,943,966 | A * | 8/1999 | Machado et al. | 108/64 |
| 5,967,058 | A * | 10/1999 | Ambrose et al. | 108/64 |
| 6,032,588 | A * | 3/2000 | Williamson et al. | 108/66 |
| 6,182,580 | B1 | 2/2001 | Barrett et al. | |
| 6,363,866 | B1 * | 4/2002 | Schwartz | 108/64 |

* cited by examiner

*Primary Examiner*—Jose V. Chen
(74) *Attorney, Agent, or Firm*—Seed IP Law Group PLLC

(57) ABSTRACT

A modular table system formed of modular tables of identical design that can be interleaved to form a larger table. Each individual table utilizes a multi-level tabletop having a top mounted to a base, the top and base having nearly identical construction with an open area formed in each that aligns with the corresponding shape in adjacent tables to permit overlapping and interlacing of the tables to create a sturdy, larger table.

23 Claims, 9 Drawing Sheets

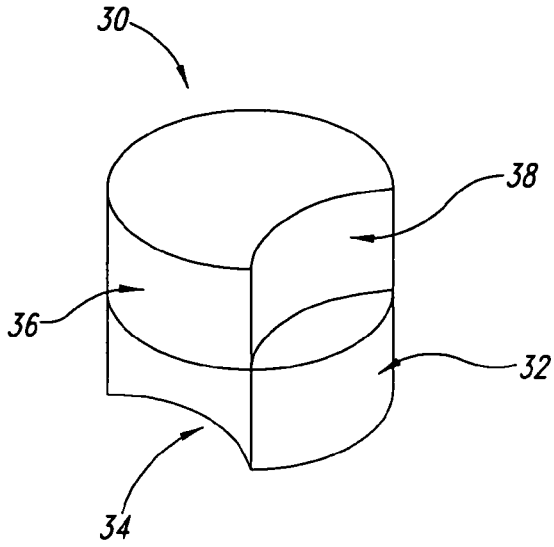
FIG. 9
FIG. 10A
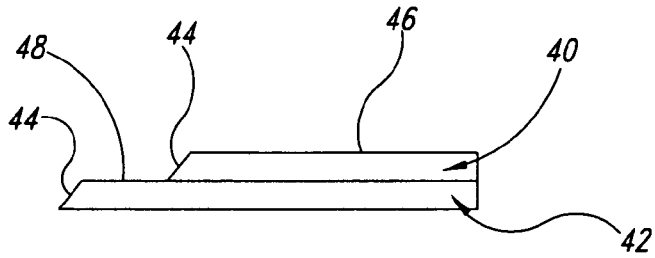
FIG. 10B
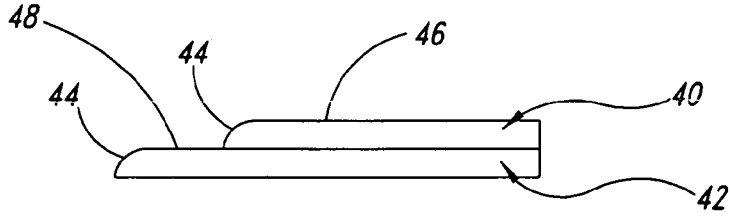
FIG. 10C
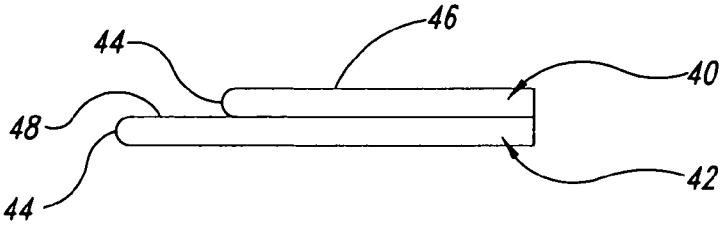

MODULAR TABLE SYSTEM

BACKGROUND OF THE INVENTION

1. Field of the Invention

The present invention pertains to modular furniture and, more particularly, to a tabletop design that interlaces with similar tabletop designs to form a larger tabletop.

2. Description of the Related Art

Conventional tables typically utilize one or more removable leaves or inserts to extend or reduce the usable surface area of the table. Typically, the table is split and extended to form an open space utilizing underside mounted tracks, allowing for one or more table leaves to be inserted into the space. This configuration reduces the overall structural integrity of the table with each added leaf. In addition, the use of extra leaves generally limits the extended length because of the inherent structural weakness. In addition, this approach provides no opportunity to change the width of the table. Moreover, the system of extending tables with leaves also mandates separate storage of the leaf or leaves between uses.

BRIEF SUMMARY OF THE INVENTION

The disclosed embodiments of the invention are directed to a modular tabletop in one embodiment, a modular table in another embodiment, and a modular table system in yet a further embodiment. In accordance with the first embodiment of the invention, a modular tabletop is provided that includes a top having a removable section that forms an opening in the top configured to receive a similarly-shaped mating portion of another tabletop to form a larger tabletop.

In accordance with another embodiment of the invention, a modular tabletop is provided, the tabletop having a base layer with a portion removed therefrom to form an opening having a predetermined shape; and a top layer having a portion removed to form an opening having the predetermined shape, the top layer positioned on top of the base layer so that the opening in the top layer does not overlap the opening in the base layer.

In accordance with yet another embodiment of the invention, a modular table is provided, the table having a base layer having a circular plan form configuration with a crescent-shaped cutout; and a top layer having a circular plan form shape with a crescent-shaped cutout, the top layer positioned on the base layer so that the crescent-shaped cutout of the top layer does not overlap the crescent-shaped cutout of the base layer.

In accordance with still yet another embodiment of the invention, a modular table system is provided, the system including a plurality of modular tables, each modular table having: a tabletop having a removable section that forms an opening in the tabletop configured to accommodate a portion of another tabletop in butting relationship to form a larger tabletop; and a support structure to support the tabletop.

In accordance with yet another embodiment of the invention, a modular table system is provided having a plurality of tables, each table comprising a top having a circular plan form shape with a crescent-shaped cutout of same radius as the top; and a support structure to support the top.

In accordance with another aspect of the foregoing embodiment of the invention, a base is provided for supporting the top, the base having a circular plan form shape with a crescent-shaped cutout of same radius as the base and positioned below the top and on top of the support structure, the top positioned on the base so that the cutout is positioned radially 90 degrees apart from the cutout of the base.

As will be readily appreciated from the foregoing, the disclosed embodiments of the invention provide simple and cost-effective modular table units that can be utilized individually or matched together to form a larger table. Each modular table is a self-contained unit with no additional support legs, mechanisms, materials, or hardware that is required to complete the assembly of a larger table from the combination of multiple, identical modular table units. The use of a top and underlying base with matching cutouts or openings greatly improves the ease of forming a larger tabletop while increasing the structural integrity of the same without relying on additional hardware.

BRIEF DESCRIPTION OF THE SEVERAL VIEWS OF THE DRAWING(S)

The foregoing features and advantages of the present invention will be more readily appreciated as the same become better understood from the following detailed description when taken in conjunction with the accompanying drawings, wherein:

FIG. 9 is an isometric illustration of a further embodiment of the invention; and FIGS. 10A–10C are side views and FIGS. 10D–10E are top views of another embodiment of the invention.

DETAILED DESCRIPTION OF THE INVENTION

The modular table units of the present invention employ a multi-layer or molded tabletop design. The basic tabletop design can be divided into two horizontal planes bisecting the overall thickness of the tabletop. This basic tabletop design features two concave cutout sections of substantially the same size and shape, one situated on the upper horizontal plane and one situated on the lower horizontal plane. The concave upper and lower cutout sections are designed to facilitate assembling modular table units into a larger table by overlapping and interlacing individual table units. This is accomplished by correctly positioning the concave cutout section of one modular table unit in abutting relationship with the corresponding convex periphery of another modular table unit of the same design. Because the concave and convex portions are formed to have the same radius of curvature, the fit should be without gaps or spaces between these two sections of the tables.

Figure 1:
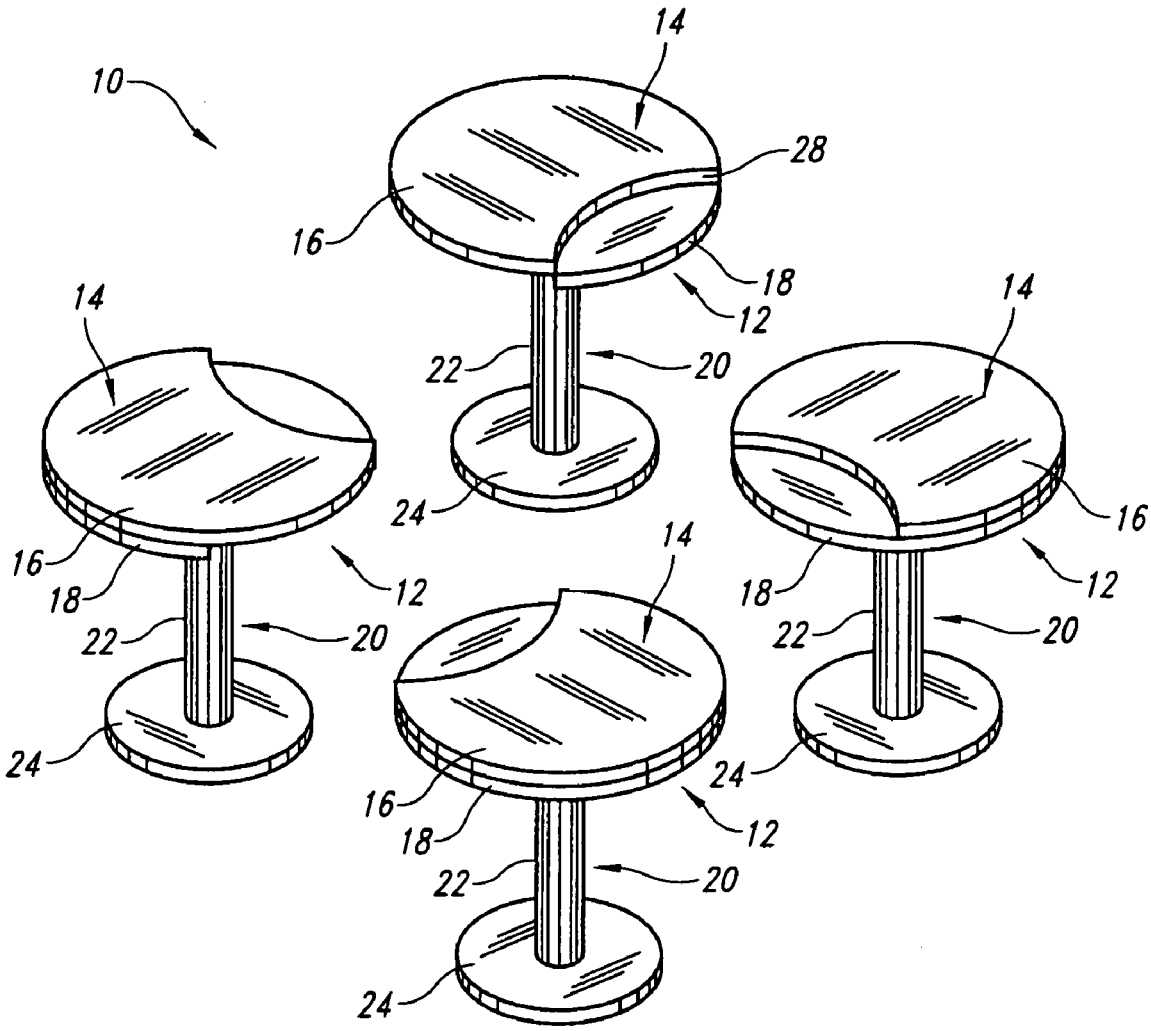
FIG. 1 is an isometric illustration of a modular table system showing the individual components prior to interlacing in accordance with the present invention.

Referring initially to FIG. 1, shown therein is a modular table system 10 formed in accordance with the present invention consisting of a plurality of tables 12. Each table 12 has a tabletop 14 that includes a top 16 placed on top of a base 18. A support structure 20 is positioned under the base and includes a pedestal 22 resting on a stand 24. The stand 24 is sized and shaped to stably support the table 12 on a support surface, such as a floor, patio, deck, and the like.

Figure 2:
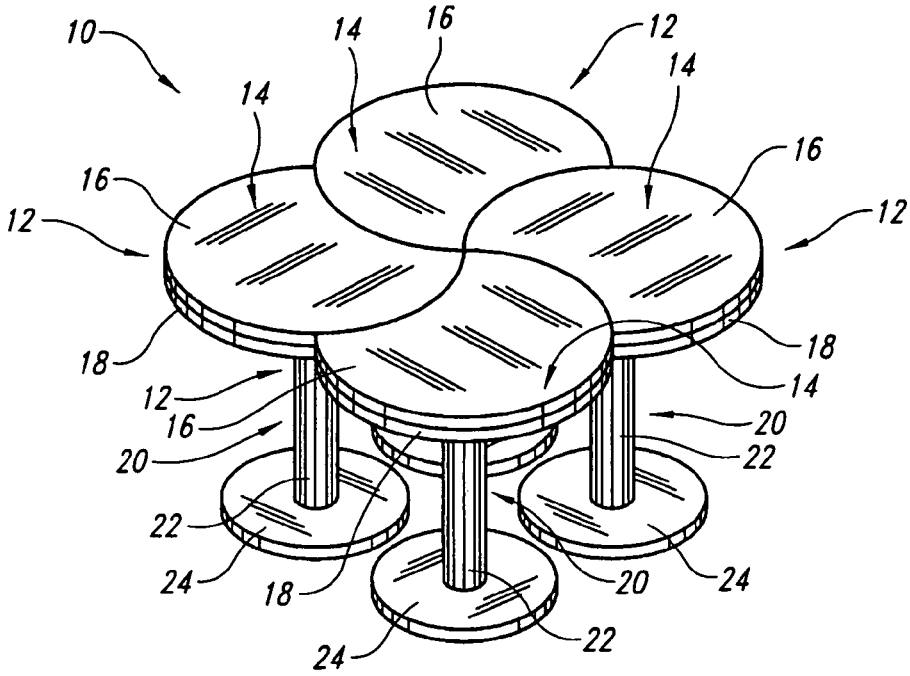
FIG. 2 is an isometric projection of the modular table system in the interlaced configuration to form a single enlarged tabletop from the four individual tabletops formed in accordance with the present invention.
Figure 6:
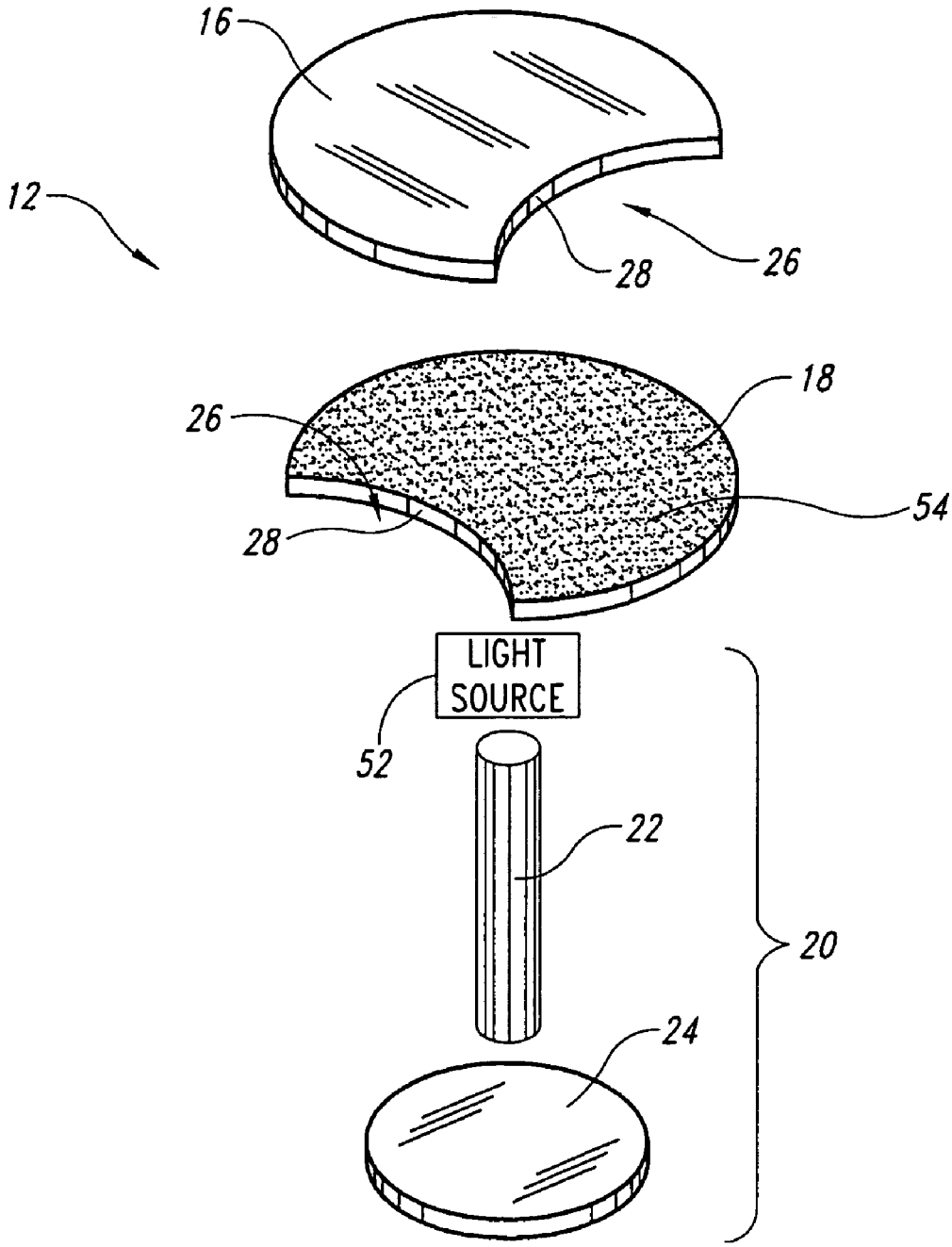
FIG. 6 is an exploded isometric projection of a modular tabletop formed in accordance with the present invention.

Each modular table 12 is configured to slide into engagement with at least one, and preferably two, adjacent tables, as shown in FIG. 2, to form an enlarged table. This is accomplished by forming each top 16 to have a removed section creating a concave open area 26 in the top. In the embodiment shown in FIG. 1, the top 16, as well as the base 18, each has a circular plan form configuration and the open area 26 is crescent-shaped. The radius of the open area 26, which defines the concave sidewall 28 in the top 16, is the same radius as the circular top 16. Similarly, the base 18, as shown more clearly in the exploded view of FIG. 6, has a crescent-shaped open area 26 with an arcuate sidewall 28 defined by a radius that is the same radius for the circular base 18. Ideally, the top 16 and the base 18 are of the same size and shape, with the top 16 having an exposed finish of a higher quality than that of the base 18.

When the top 16 is placed on the base 18, the open area 26 of the top is positioned to not overlap the open area 26 of the base 18. Ideally, the two open areas are positioned radially 90 degrees apart when the top 16 is placed on the base 18. This orientation allows two tables 12 to be interlaced with this table 12 at 90° orientation. It is to be understood that other orientations are possible, such as 180° to form an enlarged table of the same width but extended length.

Each modular table 12 can interleave with two adjacent modular tables by simply sliding them together so that the open area 26 of the base 18 of a first table 12 is aligned with the open area 26 of the top 16 of an adjacent table 12. When the tables are slid together, the portion of the top 16 projecting over the open area 26 of the base slides into the open area 26 of the adjacent top 16. Similarly, the portion of the base 18 extending beneath the open area 26 of the top 16 slides into the open area 26 of the adjacent base 18 and under the projecting top 16. The interleaving of four tabletops 14 in this manner as shown in FIG. 2 yields a tabletop with an enlarged surface area that is supported by four supporting structures 20. This arrangement achieves the same or greater stability as a table of the same size with four legs. It is to be understood that while the base 18 component could be eliminated and only the top 16 be used, it may be necessary to use mechanisms such as latches or other similar devices to hold the tops 16 into engagement. In the configuration that uses the multi-layer combination of the base 18 and the top 16, such retention mechanisms may not be necessary although they could be used if desired.

Figure 3:
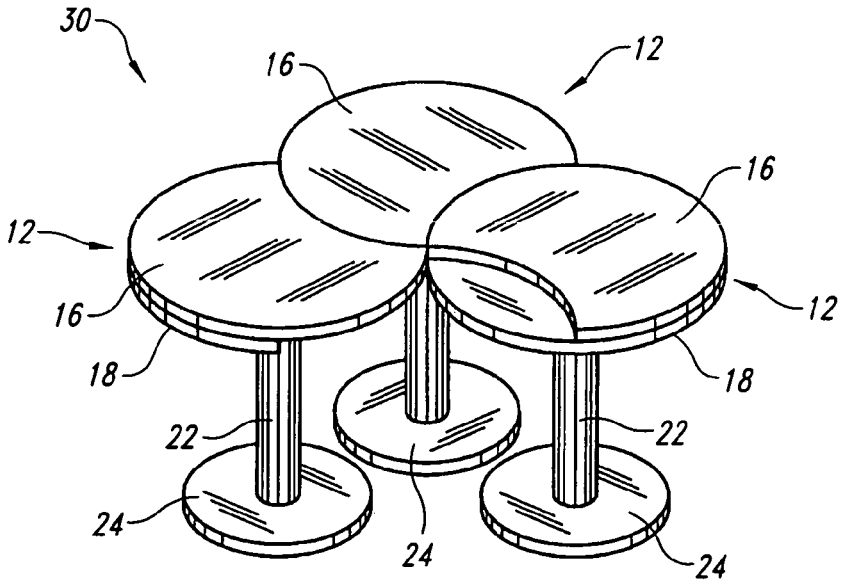
FIG. 3 is an illustration of an alternative embodiment of the invention utilizing three modular tabletops interlaced to form a single enlarged tabletop.
Figure 4:
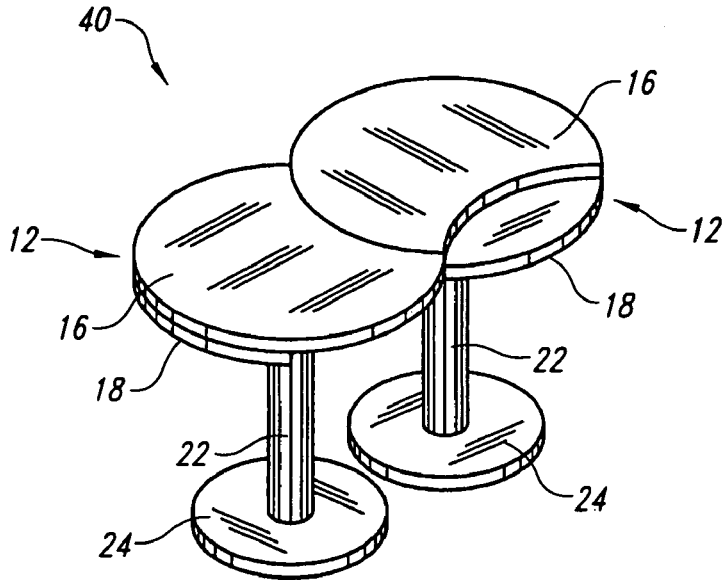
FIG. 4 is an isometric projection of a modular table system formed in accordance with another embodiment of the invention wherein two modular tables are interlaced together to form an enlarged tabletop.
Figure 5:
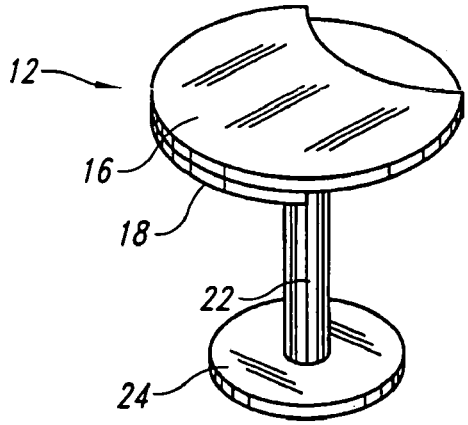
FIG. 5 is an isometric illustration of another embodiment of a modular table formed in accordance with the present invention.

The modular design of the table 12 yields itself to other combinations, such as those shown in FIGS. 3 and 4 wherein the modular table system 30 of FIG. 3 utilizes three tables 12 and the modular table system 32 of FIG. 4 utilizes two tables. When less than four tables are used, the unused open area 26 can be filled in with a matching section to present a uniformly planar top surface.

Figure 7A:
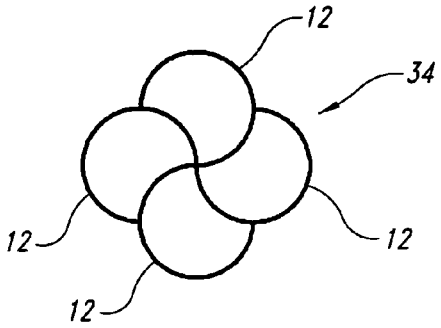
FIGS. 7A–7J are top plan form views of alternative modular table system designs formed in accordance with the present invention.
Figure 7B:
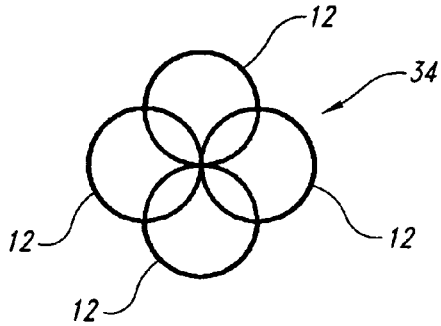
Figure 7C:
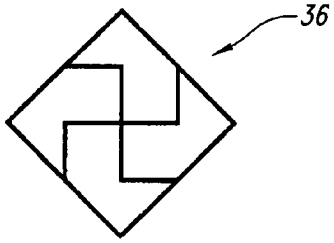
Figure 7D:
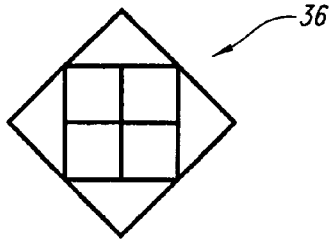
Figure 7E:
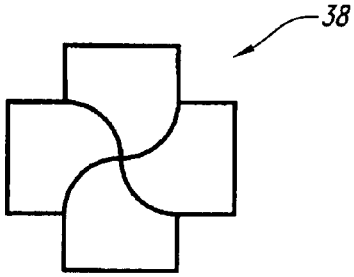
Figure 7F:
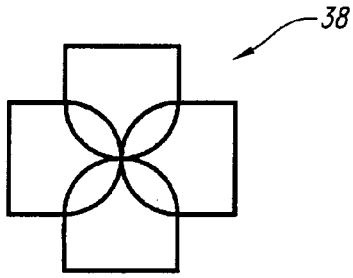
Figure 7G:
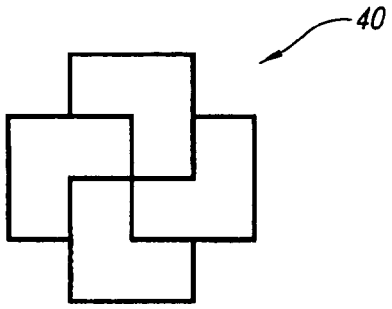
Figure 7H:
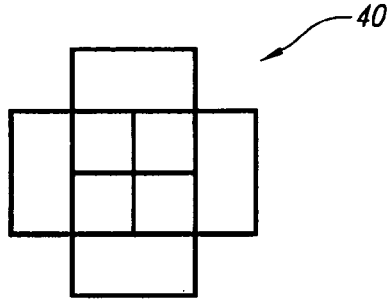
Figure 7I:
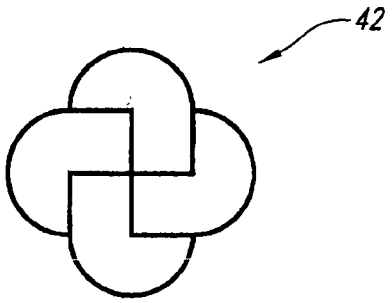
Figure 7J:
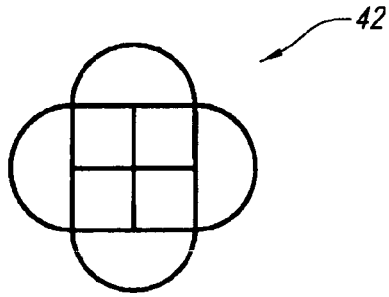

It is also to be understood that other table shapes other than the circular plan form configuration can be used in accordance with the teachings of the present invention. For example, shown in FIGS. 7A–7J are alternative designs or orientations of modular table systems. For example, in the modular system 34 shown in FIGS. 7A–7B, the top 16 is positioned on the base 18 so that the top 16 is radially 180 degrees different than the orientation of the top 16 on the base 18 of the modular table 12 shown in FIGS. 1–6. FIG. 7B shows, without phantom lines, the positioning of each table 12 with respect to the other tables 12. While the ultimate result is the same, the pattern formed by the intersecting sides is a mirror image of that shown in the top plan view of FIG. 7A.

FIGS. 7C–7J show alternative designs utilizing the principles of the present invention. In each design, approximately a quarter of the tabletop 16 is removed as is a quarter of the base 18, with the top 16 and base 18 positioned to permit interlacing or interleaving of at least one, and preferably two, adjacent tables.

Figure 8A:
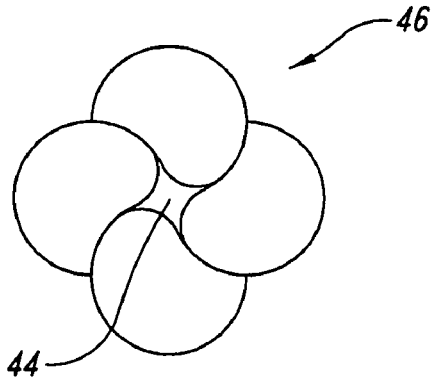
FIGS. 8A–8C are top plan form views of alternative embodiments of modular table systems formed in accordance with the present invention.
Figure 8B:
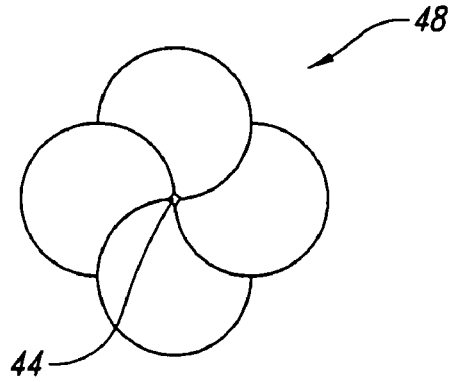
Figure 8C:
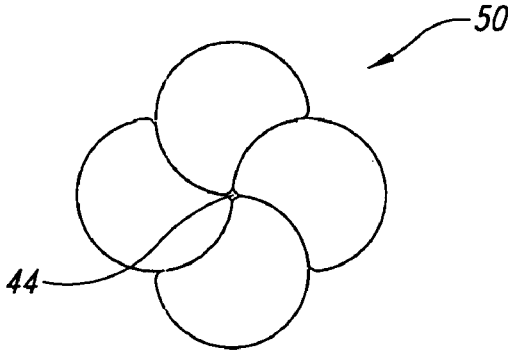
Figure 10D:
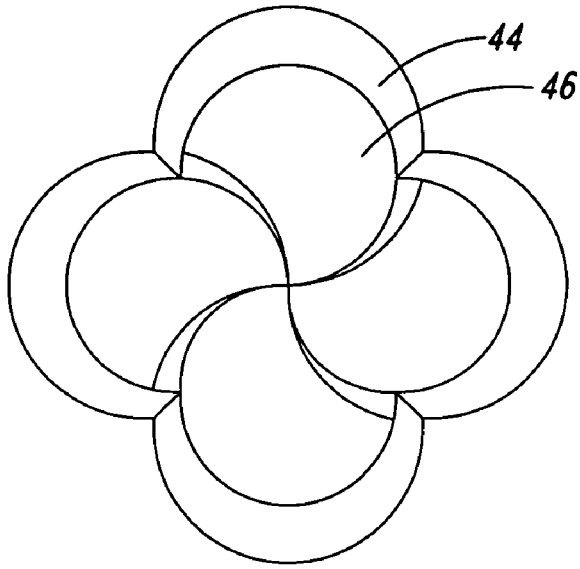
Figure 10E:
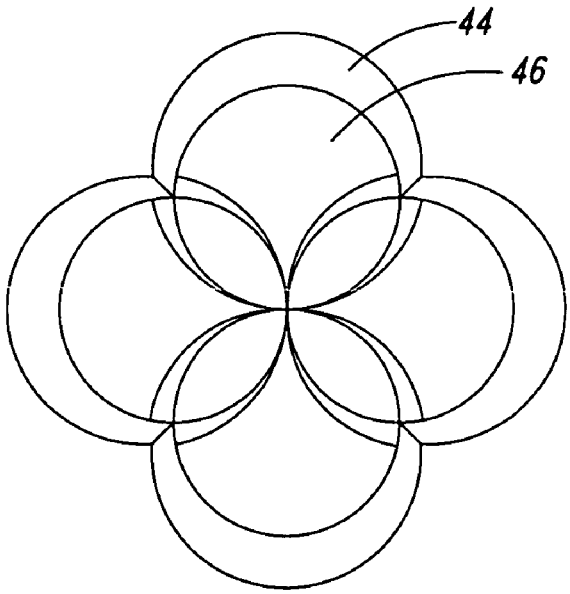

Other variations are also possible, as shown in FIGS. 8A–8C. Here, a center opening 44 is provided to enable the use of a table umbrella on a pole (not shown) which is inserted through the opening 44 and supported by a base (not shown). Planting pots, serving trays, and the like may also be mounted or placed in the opening 44 depending upon its size. More particularly, in FIG. 8A, an enlarged opening 44 is created in the modular system 46 shown therein by shaping the tabletop to have a teardrop or kidney shape.

The modular table system 48 shown in FIG. 8B utilizes a circular tabletop 16, while the tabletop 16 shown in the modular table system 50 of FIG. 8C is more rounded on the corners, which provides for the opening 44.

The modular tables 12 shown and described herein can be constructed using known techniques and materials that are currently available on the marketplace. While the general design of each modular table 12 is shown divided into three broad components, the top 16, the base 18, and the support structure 20, it is to be understood that actual construction or assembly methods may not be limited to or be required to adhere to these component categorizations and descriptions.

For example, the stand 24 on which the pedestal 22 is mounted should be designed and constructed with consideration for the overall dimension of the tabletop 14. In other words, the stand 24 should be broad enough and constructed of heavy enough material to support the table's overall structural requirements and to prevent unwanted lateral movement, i.e., tipping. While the shape and design of these stands, and for that matter the pedestal 22, is not restricted, special care should be taken so that neither the design nor the material interferes with the assembly of the modular tables 12 into the system configuration.

The preferred construction of the pedestal 22 is of a single vertical shaft of sufficient thickness to support the modular table's overall structural requirements. For example, if the tabletop 14 is granite or steel, this mandates the use of sturdier materials for the pedestal 22 than if the tabletop were constructed of extruded synthetic material. While the preferred method of attaching the pedestal 22 to the tabletop 14 is by industrial-grade stainless steel screws, such as 10–24 by 1 inch, or similar, it is to be recognized by those of skill in the art that other screw sizes, materials, and fastening or attaching devices or techniques may be readily substituted as desired. Alternatively, the present invention may be constructed as a single integrated unit, requiring no attaching hardware.

As noted above, the basic design of the tabletop 14 can be divided into two horizontal planes or layers, the top 16 and the base 18, each plane or layer featuring an area roughly equal to one-quarter of the overall surface area of the modular system 10. The open area 26 formed of a concave reversed-order circumference is of substantially the same size and shape. While the modular tables 12 are intended for matching together with modular tables 12 of identical construction and style, it is to be understood that the designs in general may vary in shape and dimension as described above.

It is to be appreciated that while a preferred embodiment of the invention has been illustrated and described along with numerous variations therein, the examples illustrated and described herein do not represent the complete range of variations in shape nor are they intended to limit the scope of the accompanying claims.

In accordance with another embodiment of the invention, the tabletop 16 can have the open area 26 filled in by a removable section so that when the table 12 is used alone, the entire surface area is available for use. The removable section can be attached by hinges or other devices that allow it to remain attached to the top 16 or to the base 18, or it can be dropped down when the top 16 is used without the base 18. In other words, the removable section can slide down at least a distance equal to the thickness of the top 16 and remain in place to provide a supporting shelf for an adjacent table that is interleaved with the modified table 12. The mechanics and method of insertion can include, but are not limited to, a spring-loaded removable section that retracts with external pressure and extends to its original position when the pressure is released; or a sliding leaf that relies on fabricated tracks, rollers, or other means to successfully retract into the body of the modular table.

In another embodiment of the invention, the removable section can contain or be constructed of a material that provides some degree of illumination.

In addition, the overall support structure for the modular table 12 can be achieved by means of novel, unique, or distinctive support structures and materials that may include, but are not limited to, fashioned wrought iron, transparent columns or pedestals filled with some material for the purpose of decoration, education, or advertising, or the use of wood, mixed construction media, and the like.

The design and functional features described herein can also be applied to non-pedestal table supports and to other articles of furniture, such as ottomans, footstools, and day beds. FIG. 9 illustrates a design 30 in which a lower section 32 having an open section 34 provides support for an upper section 36 that has an open section 38. As such, this design 30 is configured to interleave with other designs 30 in the manner described above with respect to the other embodiments of the invention.

Shown in FIGS. 10A–10E are illustrations of another alternative embodiment of a table top 40 supported on an underlying base 42 wherein the sides 44 of the top 40 and the base 42 are not orthogonal to the adjacent surfaces 46, 48, respectively. In other words, the sides 44 may be rounded, angled, such as at 45 degrees, or both rounded and angled.

In accordance with another embodiment of the invention, the entire top or base, or both, or portions thereof, may be formed of either transparent or translucent material that admits light there through. A source of illumination 52 shown in FIG. 6 as a generic black box, such as a light bulb powered by batteries, AC house current, or solar panel, may be included, preferably mounted in the top or the base or both, or mounted below the top or below the base, such as in the support structure. The transparent or translucent material may be clear or formed of tinted material 54 to provide viewable colors. Alternatively, the top may be one color and the underlying base may be another color such that when the top and base overlap at the cutout portions, a third color is visible.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A modular tabletop for use with a first complementary tabletop mounted on a first support and having a mating portion formed thereon and a second complementary tabletop having a base mounted on a second support, the modular tabletop comprising:

a top having a removable section that forms an opening in the top configured to receive the mating portion of the first complementary tabletop mounted on the first support structure to thereby form a larger tabletop; and a base on which the top is mounted, the base mounted on a support structure, the base having a section removed therefrom that is shaped to accommodate the base mounted on the second support of the second complementary tabletop to enable the modular tabletop to dovetail together with the first and second complementary tabletops.

2. The modular tabletop of claim 1, wherein the top has a circular plan form shape, and the removable section has a crescent shape.

3. A modular tabletop, comprising:

a base having a portion removed therefrom to form an opening having a predetermined shape; and a top mounted on the base and having a portion removed to form an opening having the predetermined shape, the top positioned on the base so that the opening in the top does not overlap the opening in the base.

4. The modular tabletop of claim 3, wherein the openings of the top and the base have the same size.

5. The modular tabletop of claim 3, wherein the opening in the top is positioned radially 90 degrees from the opening in the base.

6. A modular tabletop, comprising:

a base layer having a circular plan form configuration with a crescent-shaped cutout; and a top layer mounted on the base layer and having a circular plan form shape with a crescent-shaped cutout, the top layer positioned on the base layer so that the crescent-shaped cutout of the top layer does not overlap the crescent-shaped cutout of the base layer.

7. The modular tabletop of claim 6, wherein the crescent-shaped cutout of the top layer is of equal size to the crescent-shaped cutout in the base layer.

8. The modular tabletop of claim 7, wherein the top is positioned on the base such that the crescent-shaped cutout of the top is positioned radially 90 degrees apart from the crescent-shaped cutout of the base.

9. A modular table, comprising:

a modular tabletop, comprising:

a top having a removable section to form a cutout in the top that is configured to accommodate a similarly-shaped portion of another tabletop to form a larger tabletop; and a base on which the top is mounted, the base mounted on at least one support structure for supporting the base, the base having a further cutout configured to accommodate a further tabletop, the base and the top positioned so that the further cutout of the base does not overlap the cutout of the top.

10. The modular table of claim 9, wherein the removable section of the top is attached to the top and configured to remain attached to the top when the opening is formed.

11. The modular table of claim 9, wherein the top has a circular plan form configuration and the removable section is crescent-shaped.

12. The modular table of claim 9, wherein the top has a circular plan form shape and the bottom has a circular plan form shape, and the removable section of the top and the cutout of the bottom each have a crescent shape, and wherein the top and the base have the same size and the respective crescent shape removable section of the top and the cutout of the base are of the same size.

13. The modular table of claim 12, wherein the top is positioned on the base so that the removable section is positioned radially 90 degrees apart from the removable section of the base.

14. A modular table system, comprising:

a plurality of modular tables, each modular table comprising:

a tabletop having a removable section that forms an opening in the tabletop configured to accommodate a portion of another tabletop in butting relationship to form a larger tabletop; and a base on which the tabletop is mounted, the base mounted on a support structure to support the base, the base having a further cutout configured to accommodate a further base, the base and the tabletop positioned so that the further cutout of the base does not overlap the cutout of the tabletop.

15. The system of claim 14, wherein the top has a circular plan form shape and the removable section is crescent-shaped and having a radius identical to a radius of the circular-shaped top.

16. The system of claim 15, wherein the base and the top each have a circular plan form configuration of the same radius, and further wherein the cutout of the base and the removable section of the top are each crescent-shaped and have a radius equal to a radius of the top.

17. A modular table system, comprising:

a plurality of tables, each table comprising a top having a circular plan form shape with a crescent-shaped cutout of same radius as the top; and a base having a circular plan form shape with a crescent-shaped cutout of same radius as the base and positioned between the top and a support structure, the top positioned on the base so that the cutout of the top is positioned radially 90 degrees apart from the cutout of the base.

18. The system of claim 17, wherein the material is tinted to provide visible color.

19. The system of claim 18, wherein the top is tinted with a first color and the base is tinted with a second color so that when the top and the base overlap, a third color is visible.

20. The system of claim 17, further comprising a light source to illuminate the top and the base.

21. The system of claim 20, wherein the source of illumination is mounted below the base.

22. A modular table for use on a supporting surface, comprising:

a base having a portion removed therefrom to form an opening having a predetermined shape; and a tabletop having a portion removed to form an opening having the predetermined shape, the tabletop positioned on the base so that the opening in the tabletop does not overlap the opening in the base, and the base configured to support the tabletop on the supporting surface.

23. A modular article, comprising:

a top section having a portion removed to form an opening having a predetermined shape; and a base section having a portion removed to form an opening having the predetermined shape, the base having a top surface on which the top section is positioned so that the opening in the top section does not overlap the opening in the base section, the base configured to provide support for the top section.

* * * * *